US006811025B1

(12) United States Patent
Kaplan

(10) Patent No.: US 6,811,025 B1
(45) Date of Patent: Nov. 2, 2004

(54) CARD HOLDER

(76) Inventor: Scot Kaplan, 205 W. 38th St. 3W, New York, NY (US) 10018

( * ) Notice: Subject to any disclaimer, the term of this patent is extended or adjusted under 35 U.S.C. 154(b) by 0 days.

(21) Appl. No.: 09/517,207

(22) Filed: Mar. 2, 2000

Related U.S. Application Data

(60) Provisional application No. 60/122,559, filed on Mar. 2, 1999.

(51) Int. Cl.[7] ..... A45C 11/18

(52) U.S. Cl. ..... 206/37; 229/72; 150/144

(58) Field of Search ..... 206/37, 38, 39.7, 206/39.8; 150/147, 149; 229/70–72; 281/31, 45

(56) References Cited

U.S. PATENT DOCUMENTS

| | | | | | |
|---|---|---|---|---|---|
| 512,882 | A | | 1/1894 | Hillhouse | |
| 1,009,687 | A | | 11/1911 | Patton | |
| 1,141,312 | A | * | 6/1915 | Brown | 229/71 |
| 1,670,343 | A | * | 5/1928 | Clemens | 206/449 |
| 1,683,584 | A | * | 9/1928 | Hogan | 229/72 |
| 2,118,964 | A | | 5/1938 | Bonnaire | |
| 2,135,865 | A | * | 11/1938 | Winokar | 229/71 |
| 2,606,653 | A | * | 8/1952 | Knudson | 206/215 |
| 2,718,911 | A | | 9/1955 | Solomon | |
| 3,433,279 | A | | 3/1969 | Seamon | |
| 3,537,728 | A | * | 11/1970 | Reese | 150/147 |
| 3,838,808 | A | * | 10/1974 | Schroeder | 229/72 |
| 4,051,996 | A | * | 10/1977 | Ross et al. | 229/72 |
| 4,216,979 | A | * | 8/1980 | Janik | 150/147 |
| 4,397,417 | A | * | 8/1983 | Carlson | 229/70 |
| 4,415,183 | A | * | 11/1983 | Benham | 281/31 |
| 4,606,553 | A | | 8/1986 | Nickerson | |
| 4,796,750 | A | | 1/1989 | Inghram | |
| 4,810,007 | A | | 3/1989 | Nam | |
| 5,080,223 | A | | 1/1992 | Mitsuyama | |
| 5,104,146 | A | | 4/1992 | Schultz et al. | |
| 5,156,898 | A | | 10/1992 | McDonald | |
| 5,337,813 | A | | 8/1994 | Ritter | |
| 5,362,103 | A | | 11/1994 | Bromberg | |
| 5,377,733 | A | | 1/1995 | Halley et al. | |
| 5,431,207 | A | * | 7/1995 | Siegel | 150/147 |
| 5,506,395 | A | | 4/1996 | Eppley | |
| 5,595,401 | A | | 1/1997 | Exline et al. | |
| 5,725,252 | A | | 3/1998 | Crum et al. | |
| 5,775,398 | A | * | 7/1998 | Siegel | 150/147 |
| 6,000,724 | A | * | 12/1999 | Holway | 281/31 |

* cited by examiner

*Primary Examiner*—John G. Weiss
*Assistant Examiner*—Michael J. Fisher
(74) *Attorney, Agent, or Firm*—Gifford, Krass, Groh, Sprinkle, Anderson & Citkowski, P.C.

(57) ABSTRACT

A card holder for protecting a card includes a pop-up panel for the inclusion of printed indicia such as a map. The pop-up panel rapidly collapses to a size slightly larger than the card within the pocket without resort to accordion folds.

23 Claims, 4 Drawing Sheets

CARD HOLDER

RELATED APPLICATIONS

This application claims priority of U.S. Provisional Application 60/122,559 filed Mar. 2, 1999, and is hereby incorporated by reference.

FIELD OF THE INVENTION

The present invention relates to a foldable card holder, and more particularly to a card holder incorporating an expandable panel.

BACKGROUND OF THE INVENTION

Currently no device exists which functions as a card holder small enough in size to carry conveniently in a garment pocket; that carries and protects one or more cards, and affords access to the cards therein and includes a conveniently operable panel. No prior art device includes in a single structure all of these aspects. Prior art devices have satisfied individual aspects, such as a wallet for card carrying and protection, a pamphlet for information, graphics, or advertising, and a business card case for small pocket convenience. Prior art structures including a printable panel have reduced printable surface down to a more manageable size using an accordion fold. A standard travel map is a good example thereof. The prior art methods of folding have proven awkward to unfold and often more awkward to refold. The present invention overcomes these limitations of the prior art.

SUMMARY OF THE INVENTION

A card holder according to the present invention includes at least one pocket where each pocket has an outer section and an inner section and the pocket is adapted to receive a standard credit card. A compactable panel is affixed to the interior section of one of the pockets. The panel being amenable to having printed indicia thereon. Another aspect of the present invention involves a card holder including at least one pocket, each pocket having an outer section and an inner section, where the pocket is adapted to receive a card. A plurality of panels are affixed to the interior section of the at least one pocket thereby forming an expandable flap further suited for receiving printed indicia. The present invention serves to protect a card within a pocket such as a credit card, transit pass, card key, identification card or the like while also providing printed indicia useful to a user on a panel which in expanded form provides a convenient page size which rapidly compacts to a size slightly larger than the card without resort to awkward accordion folds. A card holder is designed to carry a card within a suitably sized pocket. The card holder also includes an integral, compactable panel suitable for inclusion of printed indicia. In compacted form, the card holder is only slightly larger in size than a card.

DETAILED DESCRIPTION

The present invention combines a series of functions into a unique structure. The present invention is a card holder small enough in size to carry conveniently in a garment pocket; that carries and protects one or more cards, and affords access to the cards therein. The present invention also includes at least one panel. Optionally, a flap is printed with indicia and/or information. Printed indicia being readily examined and returned to a compact form.

One of the functions that the present invention performs is as a card holder. The term "card" as defined herein illustratively includes items such as a business card, convention identification badge, credit card, transit pass, card key, identification and the like. An additional function of the present invention is to protect a card from wear which could diminish the card value prematurely. Card wear illustratively includes abrading a card magnetic strip, bending a card so as to make it unreadable or unable to fit into a card reader and abrading a card surface resulting in image or information loss. A card that becomes unintelligible results in untimely replacement or a monetary loss.

As used herein "inward" denotes the direction into a sheet of flatstock. As used herein "outward" denotes the direction away from a sheet of flatstock.

The printable flap of the present invention optionally allows for the inclusion of useful printed information, graphics, or advertising.

Figure 1:
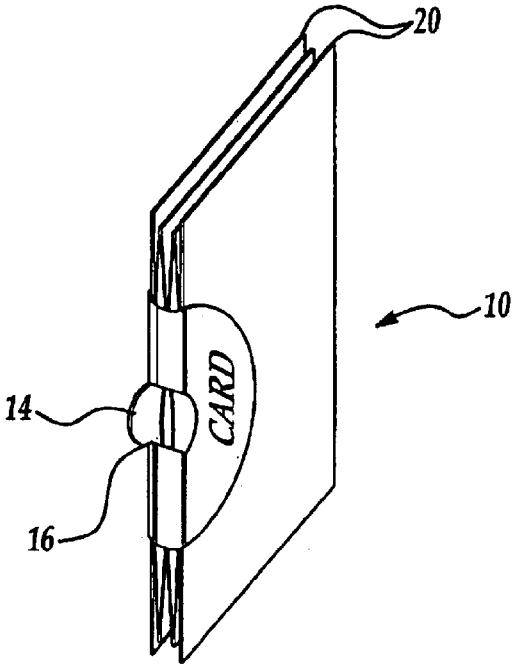
FIG. 1 is a perspective view of a card holder of the present invention in a collapsed state.

The present invention utilizes an angled scoring system to produce a panel that stores as a compact form of a card holder 10, FIG. 1; "pops up" and recomposes when closed, FIG. 2. The angled scoring produces panels having non-rectangular quadrangular panel portions that expand to produce a printable flap area much larger than the compact form, FIG. 3. It is appreciated that the present invention includes one or more of these expanding panels, in addition other types and styles of panels which can be included to produce a variety of formats depending on need.

The layouts in FIGS. 4–7 are produced from a flat sheet of material having two sides. Herein, the side that is visible in FIGS. 4–7 is described as the "front side" and the reverse, or non-visible side, is referred to as the "back side."

The card holder when fully formed and closed is 1 to 10 millimeters larger in planar dimensions than a standard credit card such as VISA or MASTERCARD. With the release of any closing feature the design will then open, in a way similar to a book. Upon opening the structure, the interior angled score lines cause panel portions that are non-rectangular quadrangles to "pop up" and open out forming a displayed area larger than the structure's size in its closed state. This expandable panel has a large printable area well suited for printing graphics or information thereon.

Additional expandable panels are added in different formations of this design, some additional non-expanding panels can also be added as described. Upon closing of the structure, the expanded panels fold down into the body of the design returning the structure to a size just slightly larger than a card.

The closing fastener is formed through a cut in one of the card holding compartments. The flap is then folded to the opposite side of the design and inserted between the opposite card compartment and the internally folded expanding flaps. This is done by first inserting the tip of the flap which bends along a score which bisects the flap and then inserting the remaining body of the flap. The closing fastener also has a tab which is used to release the closing fastener, and remove it from its locked position which is made by a cut in the flap panel.

The present invention is a compact size card holder 10 just slightly larger than an encompassed card, FIG. 1. The present invention also optionally includes a closing fastener 12 which maintains the holder 10 in a closed position. A fastener is selectively released by pulling on the small built-in tab 14.

A semi-circular notch 16 is produced by the void of fastener 12. The notch 16 is utilized for ease of access to a card pocket 20. This notch allows for a card to be pushed out of the pocket with the thumb. Thus, in many cases a magnetic strip of an encompassed card is exposed for swiping through a card reader, by pushing the card part way out of the holder. It is thus unnecessary to fully remove the card from the holder for it to be utilized.

The present invention holder is preferably produced from a unitary piece of flexible or semi-flexible flatstock material. It is appreciated that multiple piece construction of a holder of the present invention is feasible.

Figure 2:
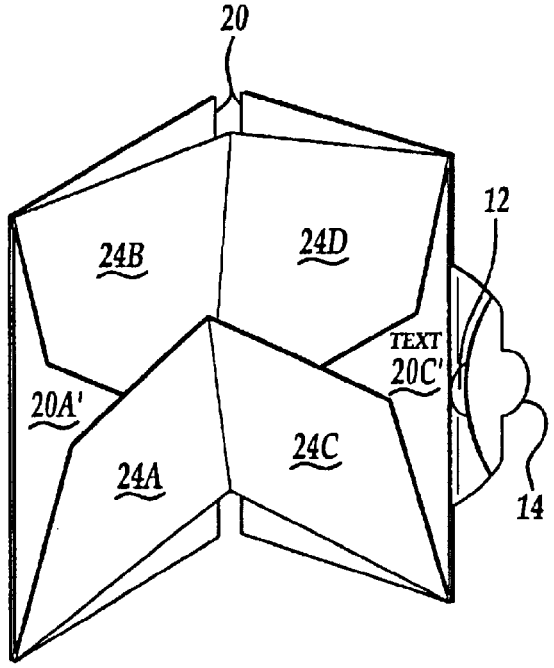
FIG. 2 is a perspective view of a card holder of the present invention in a partially collapsed state.
Figure 3:
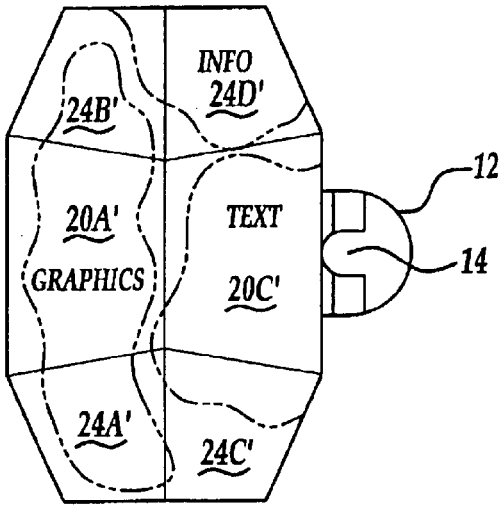
FIG. 3 is a perspective view of a card holder of the present invention in an open state.
Figure 4:
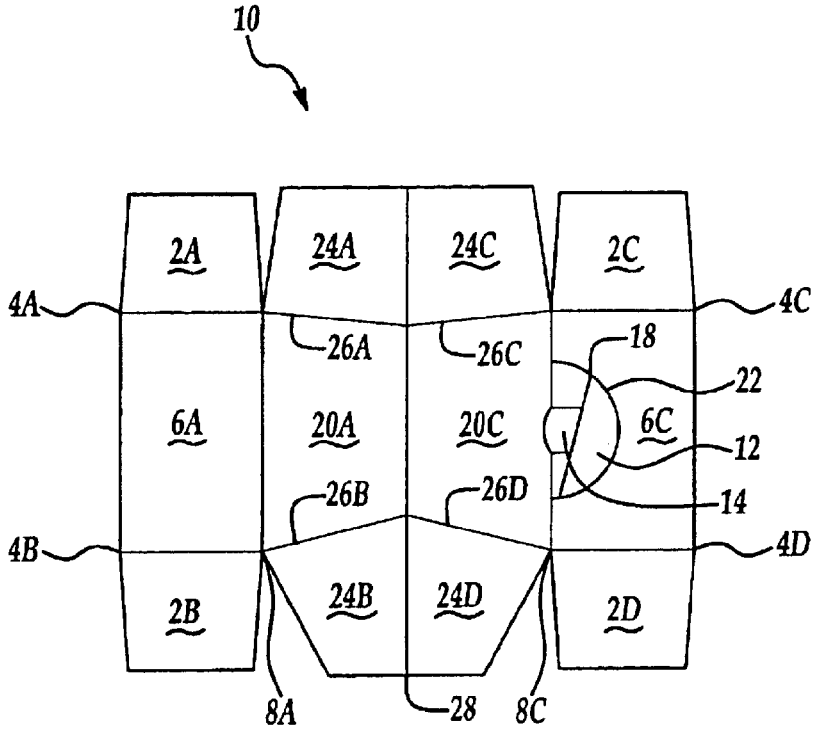
FIG. 4 is a flatstock cutout of a card holder of the present invention having a single pop-up panel.

The holder 10 depicted in FIGS. 1–3 is formed by folding small flaps 2A–2D, located at each of four corners of a holder cut out flatstock inward, along a perpendicular score line 4A–4D, respectively, as shown in FIG. 4. These folds cause the flaps 2A–2B and 2C–2D to overlap the end panels 6A and 6C, respectively. The end panels 6A and 6C are then folded inward along the perpendicular score lines 8A and 8C, respectively, to form a pocket 20 adapted for card storage. The back surfaces of 2A–2B and 2C–2D are secured to 20A and 20C respectively. Preferably 2A–2D are affixed to 20A and 20C with an adhesive or material fusion. Fastener 12 is formed by cut line 22 and can move independent of panel 6C along score line 8C. The card holder 10 is thus configured as depicted shown in FIG. 3 with the opposing sides of 20A and 20C, and 24A–24D being visible and denoted as 20A', 20C' and 24A'–24D', respectively. Folding outward along fold lines 26A–26D, followed by folding outward along fold line 28 bring the card holder 10 into a configuration depicted in FIG. 2. Securing of the fastener 12 into the region bounded by 20A', 24A' and 24B' places the card holder 10 in the configuration depicted in FIG. 1.

Figure 5:
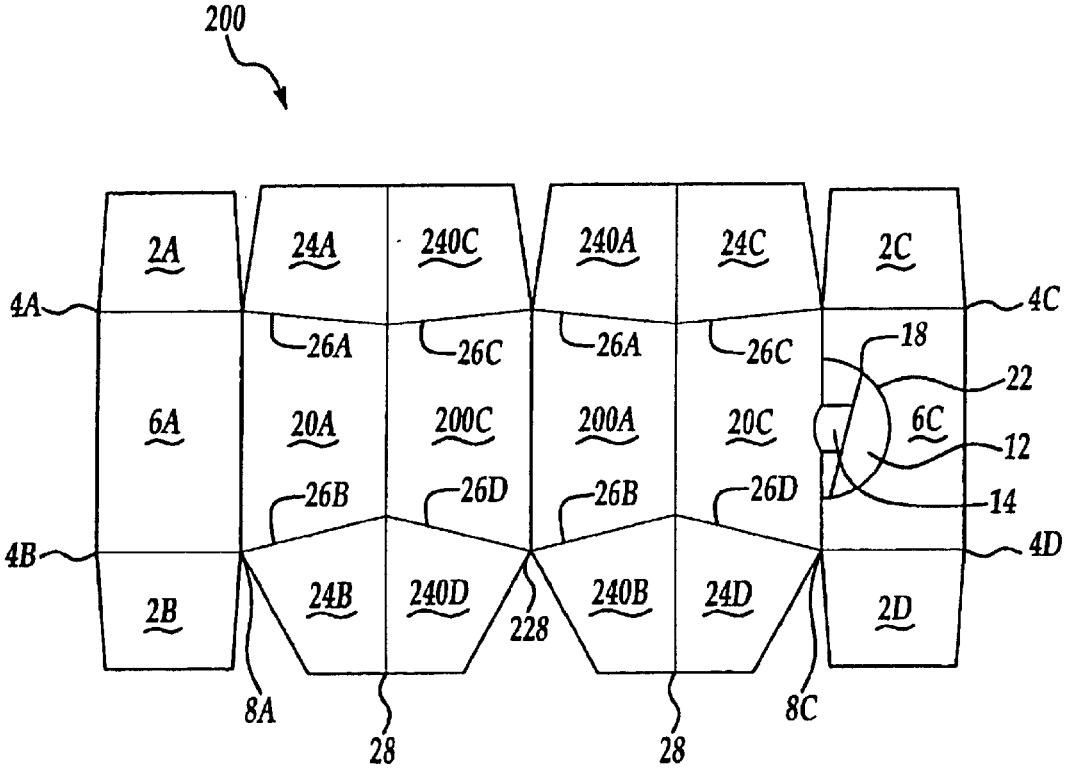
FIG. 5 is a flatstock cutout of a card holder of the present invention having two pop-up panels.

An embodiment of the present invention having two panels is shown in FIG. 5. The two panel card holder 200 is formed by folding as described in reference to FIG. 4. Section 200C is affixed to section 200A by folding inward along fold line 228 and sections 24A–24D and 240A–240D folded as described in reference to FIG. 4 to a collapsed two panel embodiment of the present invention. It is appreciated that the designs of the present invention are amenable to the addition of a plurality of panels.

Figure 6:
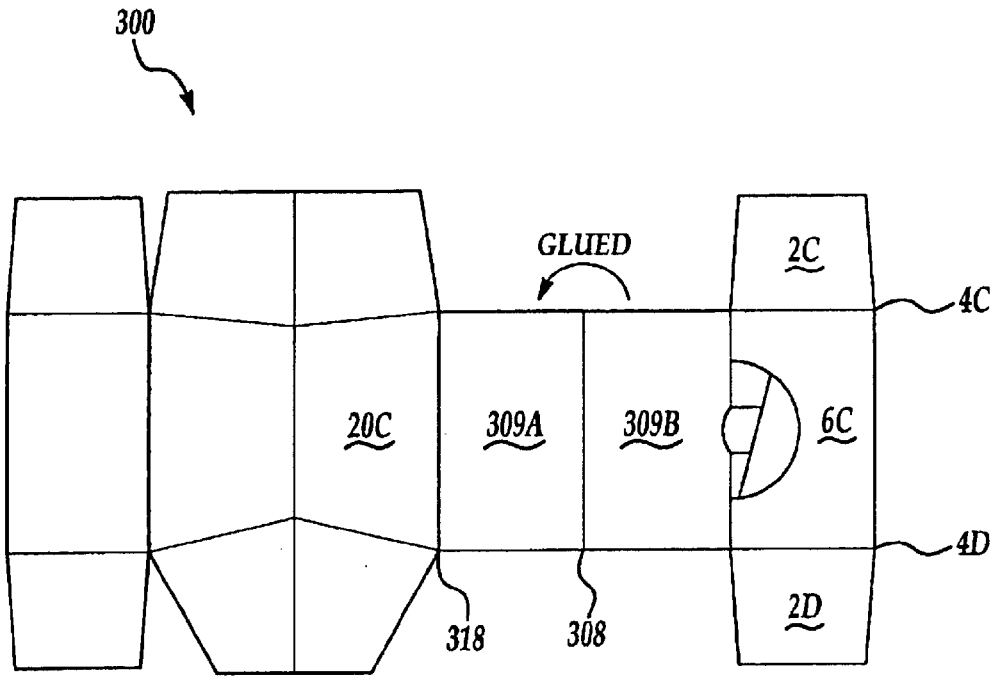
FIG. 6 is a flatstock cutout of a card holder of the present invention having a single pop-up panel and a page.

The present invention is also adapted for the optional inclusion of a further page, as shown in FIG. 6. The page containing card holder 300 has two additional sections 309A and 30B between 20C and 6C. The backsides of 2C and 2D are affixed to 309B. Panel 20C is affixed to panel 309A after folding inward along score 318. Section 309A is folded outward along fold line 318. The remainder of the steps to collapse the card holder 300 are similar to those described in reference to FIG. 4.

Optionally, one or more flaps can be added adjacent to a page such as the page constructed of sections 309A and 309B of FIG. 6. It is appreciated that when additional flaps are added to a page, a cut line may be required to allow for card holder collapse. It is further appreciated that an accordion folded sequence of flaps or similar known folding schemes is operative herein.

Figure 7:
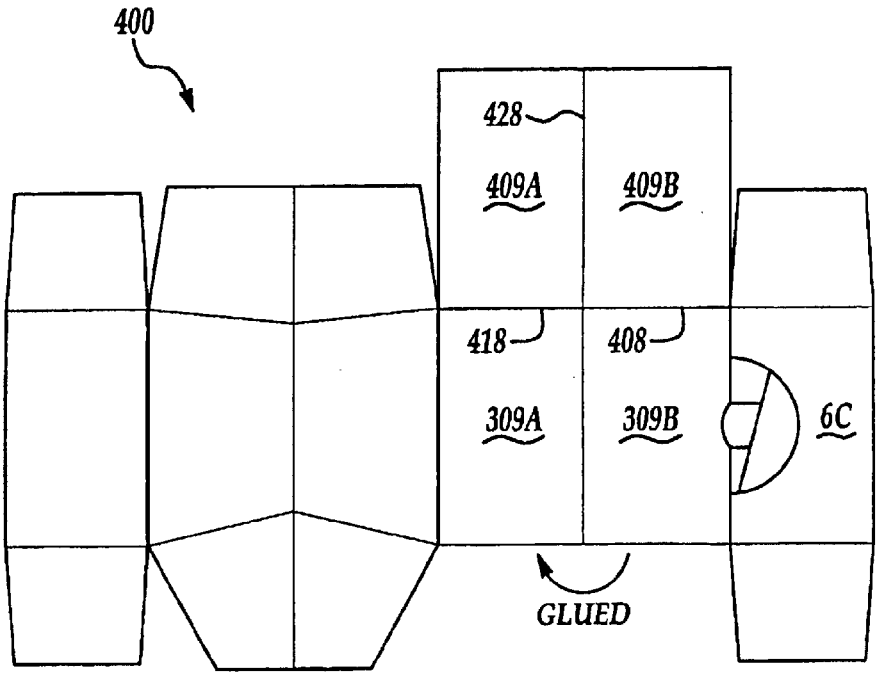
FIG. 7 is a flatstock cutout of a card holder of the present invention having a single pop-up panel and a page attached to a flap.

A card holder 400 of the present invention is shown in FIG. 7 having additional flaps. A flap 409B is foldable inward or outward along fold line 408 to bring to front side of 409B into opposition with the either section 309A or 309B. A cut line 408 separates section 409A from 309A. A fold line 428 allows section 409A to fold against section 409B, prior to collapse of the card holder 400 to a compacted form. It is appreciated that the fold lines 418 and the cut line 408 are interchanged to give a similarly useful card holder.

Figure 8:
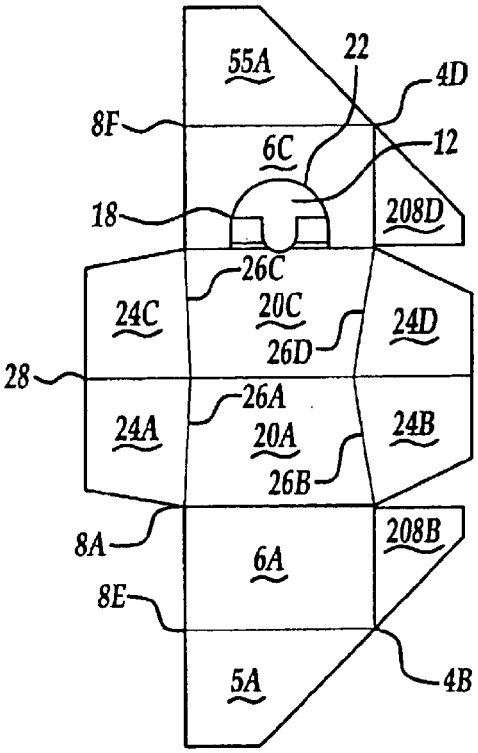
FIG. 8 is a flatstock cutout of another embodiment of the present invention having a single pop-up panel.
Figure 9:
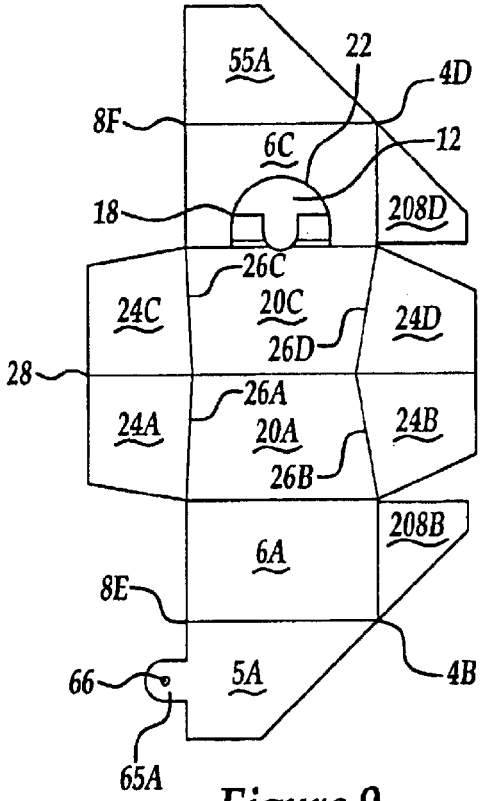
FIG. 9 is a flatstock cutout of a variant embodiment of the invention depicted in FIG. 8 having a hang tab.
Figure 10:
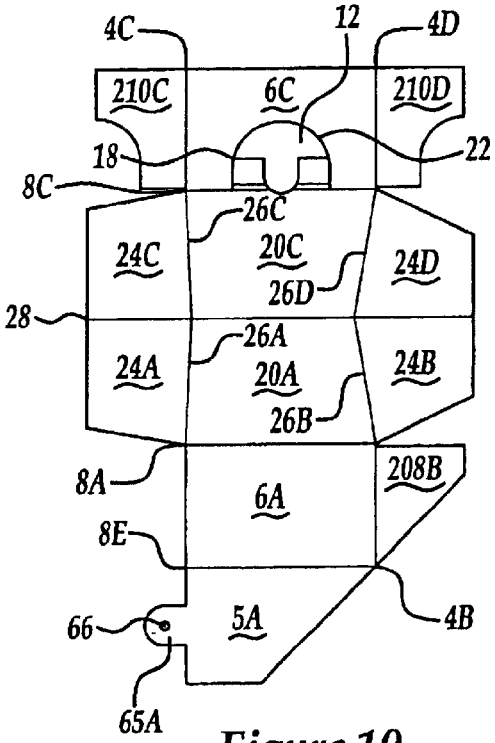
FIG. 10 is a flatstock cutout of still another embodiment of the present invention having a single pop-up panel.

Referring now to FIGS. 8–10, a card holder according to the present invention includes a single pop-up panel and a reinforced pocket as compared to the embodiment of FIG. 4. Relative to FIG. 4, folding score lines 8E and 8F have been added to attach panels 5A and 55A. Panel 55A folds inward on line 8F, thus folding over panel 6C. Panel 208D folds in along line 4D also folding over panel 6C. The backs of panels 55A and 208D then glue to panel 20C. Panel 6C is then folded inward along fold line 8C thus bringing the backsides of panels 55A and 208D in contact with panel 20C. A similar folding and gluing format occurs with panel 5A folding inward along line 8E and panel 208B folding inward along line 4B causing both panels to fold over panel 6A. The backs of 5A and 2B are then glued to panel 20A when panel 6A is folded inward along line 8A causing the backs of 5A and 2B to come in contact with 20A. With regard to FIGS. 9 and 10, 65A is a tab having an eyelet hole 66. Tab 65A serves as a hang tag by which the present invention is optionally suspended by a string. Preferably a string is configured as a loop adapted to secure about the neck or wrist of a user thereof. In particular regard to FIG. 10, flaps 210C and 210D are folded over panel 6C along score lines 4C and 4D respectively.

Various modifications of the instant invention in addition to those shown and described herein will be apparent to those skilled in the art from the above description. Such modifications are also intended to fall within the scope of the appended claims.

What is claimed is:

1. A card holder comprising:

a pocket having an outer section and an inner section, said pocket adapted to receive a card; and an expandable pop-up panel having at least two intersecting angled score lines spanning said panel intersecting a transverse score line extending to a panel edge to form a non-rectangular quadrangular panel portion, said panel affixed to the inner section of said pocket.

2. The card holder of claim 1 wherein said pocket and said panel are formed from a unitary piece of flatstock.

3. The card holder of claim 1 wherein said pocket and said panel in compacted form have planar dimensions 1 to 10 millimeters larger than a standard credit card.

4. The card holder of claim 1 wherein said pocket has a notch therein.

5. The card holder of claim 4 wherein the notch is on a side opposite of an opening of said pocket such that the card is pushed from said pocket through manual pressure.

6. The card holder of claim 5 wherein the side is adapted to receive a long axis of the card.

7. The card holder of claim 1 further comprising a fastener maintaining said holder in a closed position, said fastener defined by a cut in a flap of the pocket.

8. The card holder of claim 7 wherein said fastener is formed by folding cut flat stock.

9. The card holder of claim 7 further comprising a tab attached to said flap operative in converting said holder from a closed position to an open position.

10. The card holder of claim 1 further comprising a page integrated intermediate between the pocket and said panel.

11. A card holder comprising:

a pocket having an outer section and an inner section, said pocket adapted to receive a card; and a plurality of non-rectangular quadrangular panel portions forming an expandable pop-up panel has printed indicia that is readable upon expanding affixed to the interior section of said pocket, said pocket and said plurality of panel portions formed of a unitary piece of flat stock.

12. The card holder of claim 11 wherein said plurality of panels is two panels.

13. The card holder of claim 11 further comprising at least one page attached to one of said plurality of panels.

14. The card holder of claim 13 further comprising a flippable flap attached to said at least one additional page.

15. The card holder of claim 11 wherein angled score lines define said plurality of panels.

16. The card holder of claim 11 wherein said pocket and said plurality of panels in compacted form have planar dimensions 1 to 10 millimeters larger than a standard credit card.

17. The card holder of claim 11 wherein said pocket has a notch therein.

18. The card holder of claim 17 wherein the notch is on a side opposite of an opening of said pocket such that the card is pushed from said pocket through manual pressure.

19. The card holder of claim 18 wherein the side is adapted to receive a long axis of the card.

20. The card holder of claim 11 further comprising a fastener to maintain said card holder in a closed position, said fastener defined by a cut in a pocket flap.

21. The card holder of claim 20 wherein said fastener is formed by folding cut flat stock.

22. The card holder of claim 20 further comprising a tab attached to said pocket flap operative in converting said card holder from a closed position to an open position.

23. The card holder of claim 11 wherein said pocket is one of a plurality of similar pockets.

* * * * *